US005423258A

United States Patent [19]

Weber

[11] Patent Number: 5,423,258

[45] Date of Patent: Jun. 13, 1995

[54] CLAMPING DEVICE FOR FASTENING A FLEXIBLE PRINTING FORM ON A JACKET SURFACE OF A CYLINDER

[75] Inventor: Werner Weber, Sandhausen, Germany

[73] Assignee: Heidelberger Druckmaschinen AG, Heidelberg, Germany

[21] Appl. No.: 135,250

[22] Filed: Oct. 12, 1993

[30] Foreign Application Priority Data

Oct. 12, 1992 [DE] Germany ..... 42 34 332.1

[51] Int. Cl.[6] ..... B41F 27/12

[52] U.S. Cl. ..... 101/415.1; 101/378

[58] Field of Search ..... 101/415.1, 378, 386, 101/387, 382.1, 385, 383

[56] References Cited

U.S. PATENT DOCUMENTS

| | | | |
|---|---|---|---|
| 2,961,951 | 4/1958 | Nitchie | 101/415.1 |
| 3,410,211 | 11/1968 | Grunig | 101/415.1 |
| 3,626,848 | 12/1971 | Tafel et al. | 101/415.1 |
| 3,727,551 | 4/1973 | Kostas et al. | 101/415.1 |
| 3,757,691 | 9/1973 | Etchell et al. | 101/415.1 |
| 4,104,968 | 8/1978 | Schwaab et al. | 101/415.1 |
| 5,062,363 | 11/1991 | Reichel | 101/415.1 |
| 5,213,038 | 5/1993 | Takahashi et al. | 101/415.1 |

FOREIGN PATENT DOCUMENTS

| | | | |
|---|---|---|---|
| 0484685 | 5/1992 | European Pat. Off. . | |
| 2235119 | 2/1973 | Germany . | |
| 2017416 | 1/1974 | Germany . | |
| 2328985 | 1/1974 | Germany . | |
| 2334127 | 1/1975 | Germany | 101/415.1 |
| 2523580 | 12/1976 | Germany . | |
| 2620427 | 3/1979 | Germany . | |
| 2757552 | 6/1982 | Germany . | |
| 2116570 | 11/1983 | Germany . | |
| 261770 | 11/1988 | Germany . | |
| 0290626 | 6/1991 | Germany | 101/415.1 |
| 4035664 | 6/1991 | Germany | 101/415.1 |
| 4035627 | 5/1992 | Germany . | |
| 1274180 | 5/1972 | United Kingdom . | |
| 1535978 | 12/1978 | United Kingdom . | |
| 2092069 | 8/1982 | United Kingdom | 101/415.1 |

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

Clamping device for fastening a flexible printing form on a jacket surface of a cylinder includes a structure defining a groove formed in and across a jacket surface of a cylinder for receiving a leading end of a printing form therein, a structure defining a cylinder gap formed axially parallel in the jacket surface of the cylinder for receiving therein a trailing end of the printing form bent with an obtuse angle, a turnable clamping shaft disposed axially parallel in the cylinder and having at least one resilient element fastened thereto, the one resilient element being movable with respect to the trailing end of the printing form, the structure defining the cylinder gap including a leading lateral surface formed in the cylinder and provided with an edge engageable by the trailing end of the printing form, the one resilient element having two legs, one of which, in an unclamped condition of the clamping device, extends freely into the gap.

6 Claims, 3 Drawing Sheets

CLAMPING DEVICE FOR FASTENING A FLEXIBLE PRINTING FORM ON A JACKET SURFACE OF A CYLINDER

The invention relates to a clamping device for a flexible printing form on a jacket surface of a cylinder. The invention can be used in a particularly advantageous manner in sheet-fed rotary printing presses, wherein the plate cylinder conduit for receiving the two ends of the printing form is intended to have only a slight width.

For the purpose of clamping a flexible printing form on the jacket surface of a plate cylinder, it has become known heretofore to insert the ends of the printing form in a gap or groove machined axially-parallel into the surface of the cylinder. The ends of the printing form are held in a clamping device and are subjected to a tangential force, so that the printing form is stretched tightly on the surface of the cylinder. The ends of the printing form are plastically deformed or provided with support openings and held in a force-locking or frictionally engaged manner, respectively, for the improved handling of the printing form and the attainment of a form-locking closure. In this regard, it is noted that a form-locking connection is one which connects two elements together due to the shape of the elements themselves, as opposed to a force-locking connection, which locks the elements together by force external to the elements. In contrast therewith, a force-locking connection is one which connects two elements together by force external to the elements, as opposed to a form-locking connection which is provided by the shapes of the elements themselves.

Solutions for the foregoing problem have become known heretofore, such as by folding the leading end of the printing form at an acute angle and suspending it in a groove of the cylinder which has been undercut at the same angle. The trailing end of the printing form is gripped by a holding element fastened to an axially-parallel clamping shaft and which subjects the trailing end to a tensile force in a tangential direction when the clamping shaft rotates. Other solutions employ resilient elements embodied as a holding element and/or a clamping or tensioning element.

A device for clamping or tensioning flexible printing forms has become known heretofore from German Published, Non-Examined Patent Application DT 25 23 580 A1, wherein the ends of the printing form are respectively folded at acute angles. A bar extending behind the trailing end of the printing form, and a leaf spring with a clamping body seated at one end are fixedly connected with a clamping shaft to form holding and clamping elements. During rotation of the clamping shaft, the clamping body presses the leading end of the printing form against the lateral wall of the cylinder conduit, while the trailing end is fixed between the bar and the clamping body. During rotation of the clamping shaft, the trailing end is entrained in the tangential direction by the bar, so that the printing form is stretched tightly on the cylinder surface.

The trailing end of the printing form, folded at an acute angle, is disadvantageous during insertion into the gap. Furthermore, during clamping, the bar produces a nicking effect in the area already stressed by folding, which can negatively effect the service life and re-usability.

Because the trailing end of the printing form must be fixed between the bar and the clamping body, tensile stresses in the rotating direction occur in the printing form, which therefore cause impermissibly great stretching if the width of the fold lies near the upper tolerance limit and the friction at the surface of the cylinder is so great that the printing form does not slide during clamping.

The device disclosed in German Patent DE 26 20 427 C3 contains an elastic clamping body as a resilient element, so that even if the danger of over-stretching is reduced, the disadvantages in connection with the aforementioned nicking effect and manipulation remain. German Published, Non-Examined Patent Application DT 22 35 119 discloses a solution, wherein a double-layered leaf spring is radially fastened onto a clamping shaft, the ends of which are angled off in the tangential direction. During rotation of the clamping shaft, one leaf spring end engages the trailing end of the printing form which is hook-shaped. Besides the aforementioned nicking effect, the fact that the trailing end must be double-folded is a disadvantage. This represents an additional expense, wherein the second folding, performed at an obtuse angle, does not assure a reproducible clamping of the printing form when it is reused.

The printing form clamping device according to German Patent DE 21 16 570 C3, wherein no resilient element is provided and a stated second folding is performed only during the clamping operation, has similar disadvantages. The manipulation of the printing form during repeated clamping operations is greatly reduced thereby.

The nicking effect of a suspension bar in accordance with German Published, Non-Examined Patent Application DE 40 35 627 A1 is reduced in that the suspension bar acts against a compression spring during clamping. However, the disadvantages remain regarding the ability to manipulate a printing form doubly-folded at acute angles. In the device disclosed in German Patent DT 20 17 416, a respective clamping bar on a respective clamping shaft is provided for the two ends of a printing form, pre-folded at an acute angle, the clamping bars being supported on compression springs.

A disadvantage in this case is that two clamping bars and two clamping shafts with respectively separate drives are required, which results in increased expenditures. The acceptance of the leading end of the printing form by means of a spring-mounted clamping bar causes a floating fastening of the printing form on the cylinder, which can have disadvantageous effects upon the printing quality.

With the plate cylinder shown in German Patent DE 27 57 552 C2, which receives two printing forms on the circumference thereof, the trailing ends of the printing form are formed with bores and suspended from comb-like, resilient elements. The resilient elements are connected in a form-fitting manner with a respective clamping shaft. A disadvantage is that the insertion of the resilient elements into the bores is difficult and that the friction in the bores is increased by the clamping forces, so that the clamping conditions are changed or the printing form develops cracks in the bores and becomes unusable. In accordance with the device in German Patent DE 40 05 093 C1, the two ends of a printing form inserted into the gap are drawn in along one wall of the gap by the rough surface of an eccentrically seated clamping shaft and are fixed by means of a plate spring. With this solution, the printing form is mechanically stressed to such a degree that repeated use becomes questionable.

A further device for fastening a flexible printing form contains three clamping shafts, which are disposed coaxially and are rotatable independently of each other. Gripping bars are fastened respectively on the inner solid shaft and the inner hollow shaft. A clamping bar is screwed to the outer hollow shaft. The gripping bars permit gripping of the two ends of the printing form independently of one another, as well as an additional clamping of the trailing end of the printing form with the aid of the clamping bar. By means of compression springs disposed between the gripping bars, an even gripping force is exerted on the trailing end of the printing form. The insertion of the trailing end is problematical with this solution, because a plurality of gaps are provided which can accept the printing form. Furthermore, the solution is expensive both with regard to material and cost because of the three clamping shafts and two gripping bars and the clamping bar with the respective actuating elements.

It is accordingly an object of the invention to provide a clamping device for fastening a flexible printing form on a jacket surface of a cylinder, which can be manufactured with little expense, affords rapid clamping with a relatively low expenditure of energy, and only slightly stresses the printing form, so that multiple use is possible.

With the foregoing and other objects in view, there is provided, in accordance with the invention, a clamping device for fastening a flexible printing form on a jacket surface of a cylinder, comprising means defining a groove formed in and across a jacket surface of a cylinder for receiving a leading end of a printing form therein, means defining a cylinder gap formed axially parallel in the jacket surface of the cylinder for receiving therein a trailing end of the printing form bent with an obtuse angle, a turnable clamping shaft disposed axially parallel in the cylinder and having at least one resilient element fastened thereto, the one resilient element being movable with respect to the trailing end of the printing form, the means defining the cylinder gap including a leading lateral surface, when viewed in rotating direction of the cylinder, formed in the cylinder and provided with an edge engageable by the trailing end of the printing form, the one resilient element having two legs, one of which, in an unclamped condition of the clamping device, extends freely into the gap. It is noted, moreover, that the other leg of the one resilient member extends over or beyond the one in radial direction. It is further noted that the trailing end of the printing form, which is folded at an obtuse angle, rests against an axially extending edge which forms part of the trailing lateral surface of the gap.

An automatic clamping adjustment of the printing form is assured by the resilient element. The clamping device requires only a few components and relatively little structural space, so that it becomes possible to reduce the print-free edge of the plate cylinder, which is defined by the gap, to two millimeters. The clamping device may be realized both for cylinders having a single diameter as well as for cylinders with multiple diameters, both types being conventional in printing presses, and such a clamping device is then assigned to each printing form which is intended to be clamped onto the cylinder.

It is furthermore possible to perform clamping rapidly and with little expenditure of power, so that, with manual clamping, it is possible for the clamping device to be operated by only a single person selectively from the drive or the operating side of the printing press. The clamping is already achieved with only a 10° turn or rotation of the clamping shaft.

In accordance with another feature of the invention, the other leg of the one resilient element is formed with a rounded section extending in a direction towards the trailing end of the printing form. In the unclamped condition of the clamping device, the rounded section can rest against the leading lateral surface. If, as is customary, the lateral walls of the gap are undercut, the legs do not hamper in any way the insertion of the trailing end of the printing form. For the same reason, it is advantageous for the ends of the legs to be disposed at an inclination towards one another.

In accordance with a further feature of the invention, the other leg of the one resilient element is spring-biased against the leading lateral surface defining the gap.

In accordance with an added feature of the invention, respective ends of the legs of the one resilient element are inclined towards one another.

In accordance with an additional feature of the invention, the one resilient element is formed of a U-shaped, leaf spring-type part formed of the two legs and a connecting cross-member, the one resilient element being fastened by the cross-member to a bottom surface of a rectangularly-shaped recess formed in the clamping shaft, the one leg of the resilient element, in an unclamped condition of the clamping device, being in engagement with a lateral surface defining the rectangularly-shaped recess.

In accordance with a concomitant feature of the invention, the gap terminates in the recess.

To assure advantageous handling during the insertion of the trailing end of the printing form, the width of the recess formed in the clamping shaft should be greater than the greatest width of the gap, it being noted that, in the unclamped condition of the clamping device, the gap terminates in the recess.

Other features which are considered as characteristic for the invention are set forth in the appended claims.

Although the invention is illustrated and described herein as embodied in a clamping device for fastening a flexible printing form on a jacket surface, it is not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
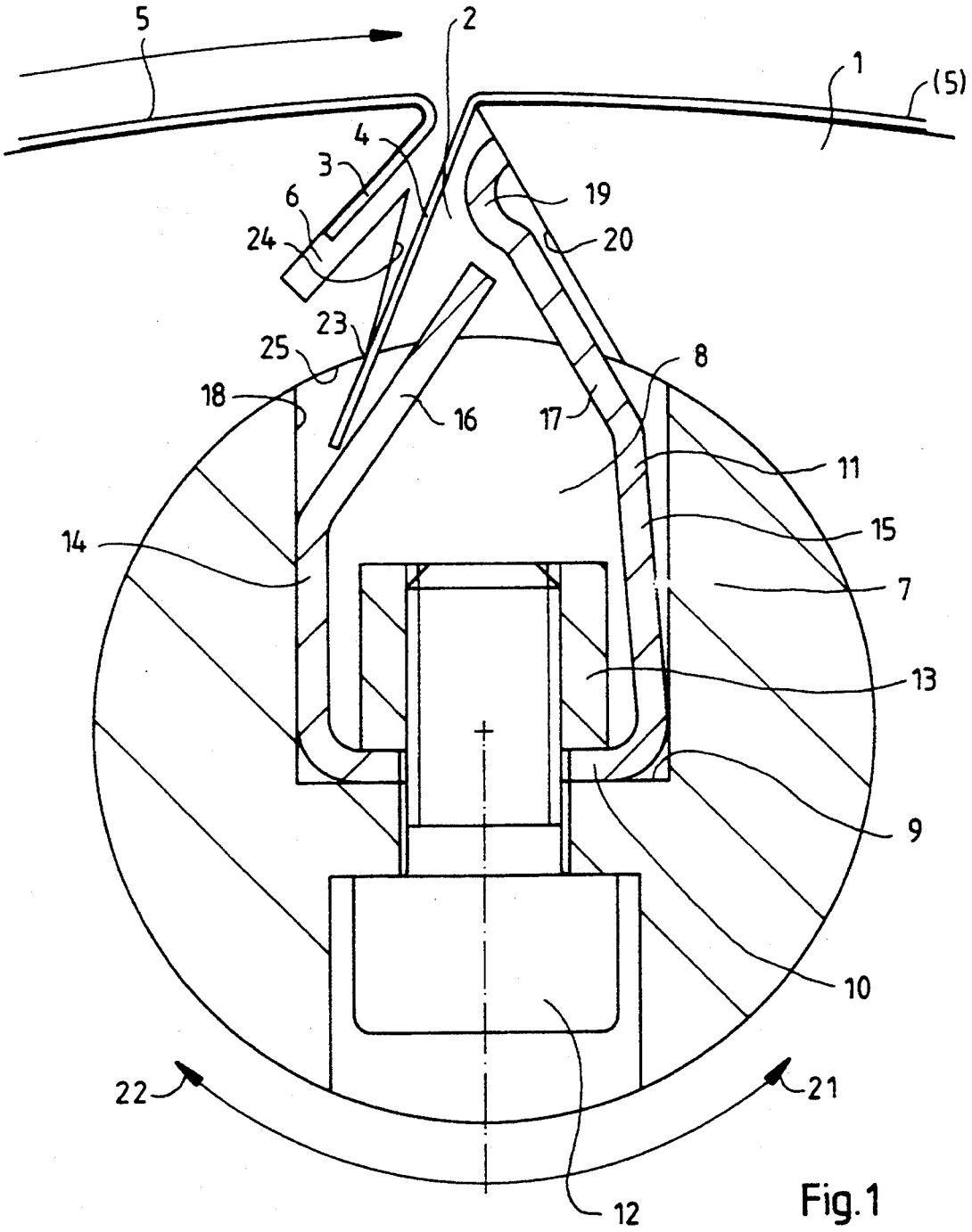
FIG. 1 is a cross-sectional view of a clamping device for fastening a flexible printing form on a jacket surface of a cylinder according to the invention which is in a released condition.

Referring now to the drawings and, first, particularly to FIG. 1 thereof, there is shown therein a plate cylinder 1 with a trapezoidal gap 2 for receiving ends 3 and 4 of a printing form 5 therein. The end 3, which leads during printing, is folded over at an acute angle and inserted into is a rectangularly shaped groove 6, the angle of inclination of which, in relation to a tangential plane extending in the gap center, essentially corresponds to the fold angle. The slit-shaped groove 6 terminates in a peripheral region of the gap 2. The trailing end 4 is folded at an obtuse angle and inserted into the gap 2. The fold width of the end 4 has been selected to be greater than that of the end 3. A clamping shaft 7 is rotatably disposed in the plate cylinder 1, and has a rotational axis which extends parallel to the axis of the shaft 1, for clamping the printing form 5 on the plate cylinder 1. A rectangularly shaped recess 8 is incised along the clamping shaft 7, and is wider than the greatest width of the gap 2 and is formed with an opening which faces the gap 2. Across the width of the plate cylinder 1, a cross members 10 of each of a plurality of U-shaped leaf spring elements 11, of which only one is illustrated, are fastened on the bottom surface 9 of the recess 8 by means of screws 12 and nuts 13. In addition to the cross members 10 thereof, the leaf spring elements 11 have two legs 14 and 15 having respective end regions which are bent at an angle, so that respective end pieces 16 and 17 of the legs 14 and 15 are inclined towards one another. In the released condition of the clamping device shown in FIG. 1, the lower region of the leg 14 rests with its entire surface against a lateral wall 18, and the end piece 16 extends freely in the lower region of the gap 2. The end piece 17 of the leg 15 extends above the end piece 16 of the leg 14, the end piece 17 terminating in a rounded section 19 and resting, in the released condition of the clamping device, against a leading lateral wall 20 defining the gap 2.

The printing form 5 can be clamped onto the cylinder 1 by turning the clamping shaft 7 about its axis in a direction represented by the arrow 21. This clamping effect can be released again by turning the clamping shaft 7 back in a direction represented by the arrow 22.

Figure 2:
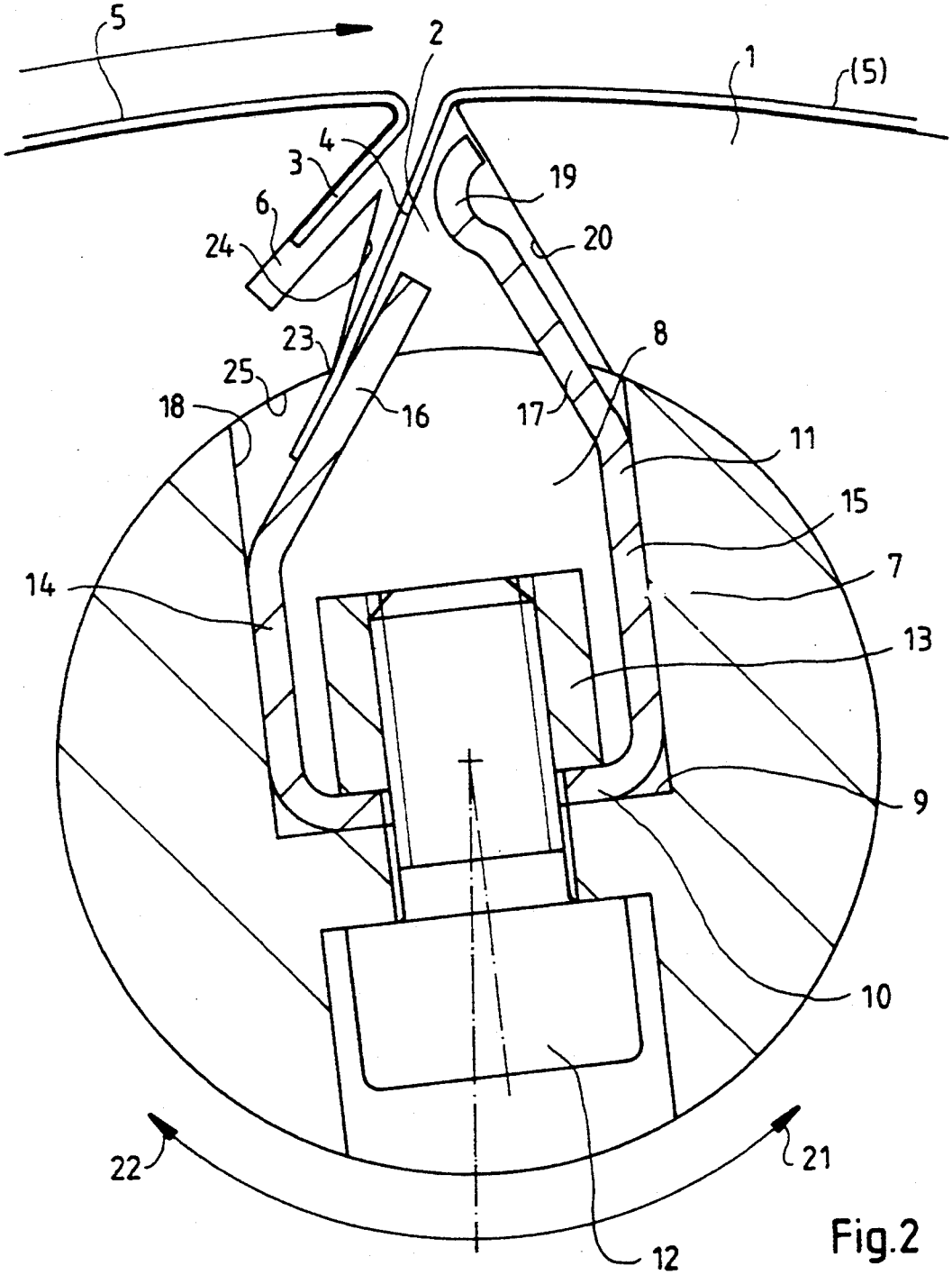
FIG. 2 is view like that of FIG. 1 wherein the clamping device is in an intermediate stage of the clamping process.

As is apparent from FIG. 2, in the first phase of clamping, the trailing end 4 of the printing form 5 is initially pressed by the end piece 16 against an edge 23, formed by the leading lateral wall 24 and an interior cylinder surface 25 defining the bore formed in the plate cylinder 1, wherein the clamping shaft 7 is received. In this regard, the end 4 can be slightly bent over the edge 23.

Figure 3:
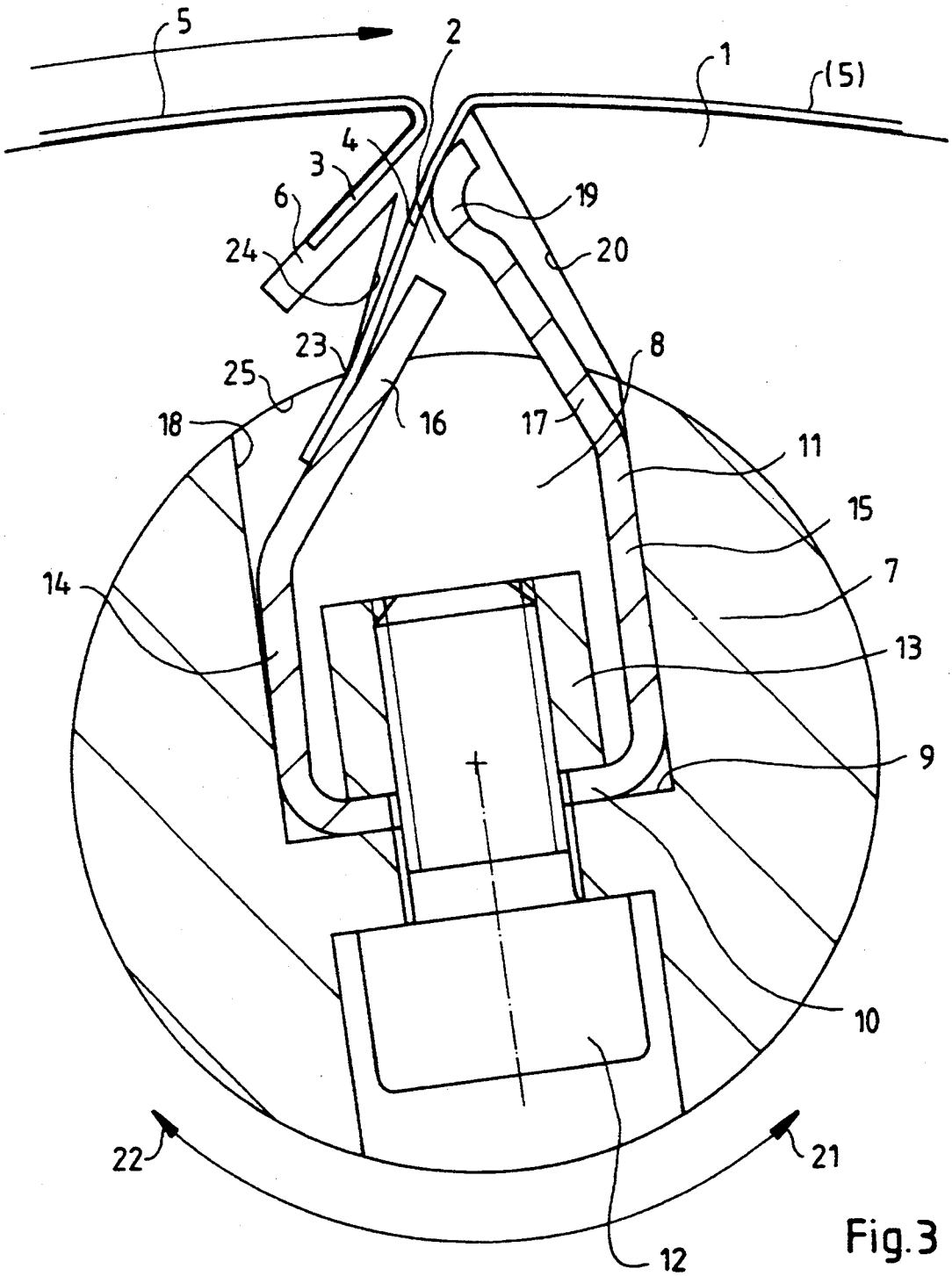
FIG. 3 is another view like those of FIGS. 1 and 2 wherein the clamping device is in a fully actuated condition.

In a further phase of the clamping operation shown in FIG. 3, a concave arch of the rounded section 19 of the end piece 17 presses against the inner surface of the end 4 of the printing form 5, tensile stress in the tangential direction being thereby exerted upon the printing form 5. The torque required for clamping the printing form 5 is permanently present at the clamping shaft 7 and can be applied with the aid of helical springs. Rotation of the clamping shaft 7 can be effected by remote control.

I claim:

1. Clamping device for fastening a flexible printing form on a jacket surface of a cylinder, comprising means defining a groove formed in and across a jacket surface of a cylinder for receiving a leading end of a printing form therein, means defining a cylinder gap formed in the jacket surface of the cylinder parallel to the axis of the cylinder for receiving therein a trailing end of the printing form bent with an obtuse angle, said cylinder gap being spaced from but intersecting said groove to form a projection which separates said cylinder gap and said groove, said projection having a leading lateral wall, a turnable clamping shaft disposed in the cylinder gap parallel to the axis of the cylinder and having at least one resilient element fastened thereto, the one resilient element being movable with respect to the trailing end of the printing form, said one resilient element having two legs, one of which, in an unclamped condition of the clamping device, extends freely into said gap and which in the clamped condition holds the trailing end of the printing form against said leading lateral wall.

2. Clamping device according to claim 1, wherein the other leg of said one resilient element is formed with a rounded section extending in a direction towards the trailing end of the printing form.

3. Clamping device according to claim 1, wherein the other leg of said one resilient element is spring-biased against said leading lateral surface defining said gap.

4. Clamping device according to claim 1, wherein respective ends of said legs of said one resilient element are inclined towards one another.

5. Clamping device according to claim 1, wherein said one resilient element is formed of a U-shaped, leaf spring-type part formed of said two legs and a connecting cross-member, said one resilient element being fastened by said cross member to a bottom surface of a rectangularly-shaped recess formed in said the clamping shaft, said one leg of said resilient element, in an unclamped condition of the clamping device, being in engagement with a lateral surface defining said rectangularly-shaped recess.

6. Clamping device according to claim 5, wherein said gap terminates in said recess.

* * * * *